US005279329A

United States Patent [19]

Pippel

[11] Patent Number: 5,279,329

[45] Date of Patent: Jan. 18, 1994

[54] FAUCET DIVERTER VALVE

[75] Inventor: Bradley J. Pippel, Grandville, Mich.

[73] Assignee: Amway Corporation, Ada, Mich.

[21] Appl. No.: 977,161

[22] Filed: Nov. 16, 1992

[51] Int. Cl.[5] ..... F16K 11/07

[52] U.S. Cl. ..... 137/625.29; 137/801; 210/433.1

[58] Field of Search ..... 137/625.29, 801, 625.43; 210/416.3, 433.1

[56] References Cited

U.S. PATENT DOCUMENTS

| | | | |
|---|---|---|---|
| 2,401,914 | 6/1946 | Di Pietro | 137/801 X |
| 2,475,702 | 7/1949 | Funke | 210/433.1 X |
| 4,212,743 | 7/1980 | Van Meter | 210/433.1 X |
| 5,083,589 | 1/1992 | Wilcock | 137/625.29 |
| 5,133,385 | 7/1992 | Kawakami | 137/625.29 X |

*Primary Examiner*—Arnold Rosenthal
*Attorney, Agent, or Firm*—Warner, Norcross & Judd

[57] ABSTRACT

A faucet diverter valve is disclosed having three positions for delivering a stream or spray of untreated water, or a flow of treated water. The position of the faucet diverter valve is selected by means of a single rotating handle. Rotation of the handle causes a valve spool to move axially within a manifold to bring fluid flow openings in the valve spool in and out of alignment with openings in the manifold. The valve spool carries seals which direct the flow of untreated water through a straight stream outlet, a spray outlet, or to a treatment loop in which untreated water passes through a treatment device, returns to the faucet diverter valve, and exits through a treated water outlet. The treatment loop return is sealed against dripping and the introduction of air by the valve spool.

27 Claims, 8 Drawing Sheets

FAUCET DIVERTER VALVE

BACKGROUND OF THE INVENTION

Field of the Invention

The present invention relates to faucet diverter valves and, more particularly, to a three-way diverter valve for delivering a stream or spray of untreated water, or a flow of treated water.

Description of the Related Art

The quality of water delivered through a faucet is a matter of concern to a great many people. The water furnished by municipal or building water supplies may be sufficiently pure for washing or rinsing purposes, but not of sufficient quality for drinking or cooking. Accordingly, devices are available which connect to a faucet and treat the water flowing out of the faucet. Such devices may either attach directly to the outlet of the faucet, or may include a diverter which directs the flow of water from the faucet, through the treatment device, and back to the faucet.

The filter and purifying media of such treatment devices are frequently consumable, so the devices are furnished with replaceable cartridges which replenish the media. Even so, it is desirable to bypass the treatment device when water quality is of lesser concern, such as when washing or rinsing, so that the life of the media may be extended as long as possible. Therefore, such devices have been provided with diverters or shutoffs which cause the water to bypass the treatment device.

It is also desirable for a faucet to be able to provide a direct stream or a spray of water, such as for filling, washing, or rinsing purposes, or a flow of treated water such as for drinking or cooking.

SUMMARY OF THE INVENTION

The present invention provides a faucet diverter valve which easily connects to a variety of conventional faucets, and which can readily and selectably deliver a stream of untreated water, a spray of untreated water, or divert untreated water to the treatment device and return the treated water to the faucet.

According to a preferred embodiment of the invention, the faucet diverter valve includes a compression ring adapter which attaches to faucets having a wide variety of diameters. At one end of the faucet diverter valve there is a rotatable handle which is selectably turned to one of three positions to deliver the desired type of flow. The underside of the faucet diverter valve includes a straight stream outlet, a spray outlet, and a treated water stream outlet. By rotating this single handle to one of its three positions, water is selectably delivered through one of these three outlets. The faucet diverter valve further includes an untreated water exit through which water is directed to the treatment device, and a treated water entrance through which treated water returns to the faucet diverter valve and thereafter flows through the treated water stream outlet.

The faucet diverter valve is provided with a generally cylindrical manifold in which is received a valve actuator in the form of a valve spool. The valve spool is caused to move axially within the manifold by the rotation of the handle. The manifold and the valve spool are provided with a number of openings which are brought in and out of alignment with each other by the movement of the valve spool. The various alignments of these openings create the necessary fluid passageways through which water is delivered selectably to either the straight stream outlet or the spray outlet, or by which water is diverted to the treatment device and returned through the treated water stream outlet.

The valve spool of the faucet diverter valve carries seals which engage the inner surface of the manifold to open and close the various fluid passageways, and which prevent intermingling of untreated and treated water. Furthermore, when the handle is in either of the two untreated flow positions, the passageway to and from the treatment device are sealed off by the valve spool, thus preventing any dripping from the treated water outlet.

These and other objects, advantages, and features of the present invention will be more fully understood and appreciated by reference to the written specification and appended drawings.

DESCRIPTION OF THE PREFERRED EMBODIMENT

Figure 1:
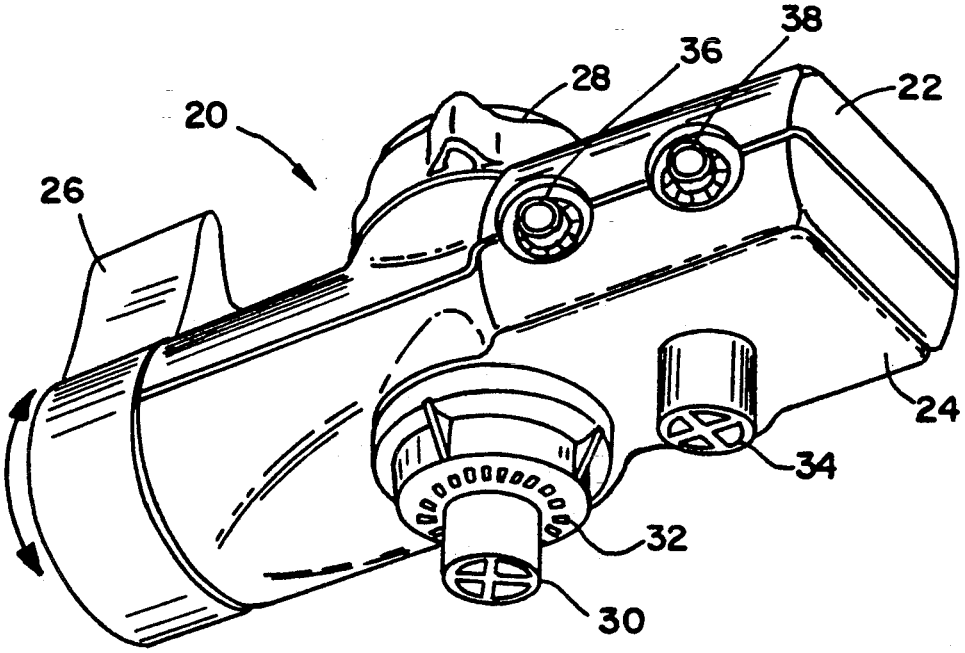
FIG. 1 is a rear and underside perspective view of a faucet diverter valve according to the principles of the invention.
Figure 2:
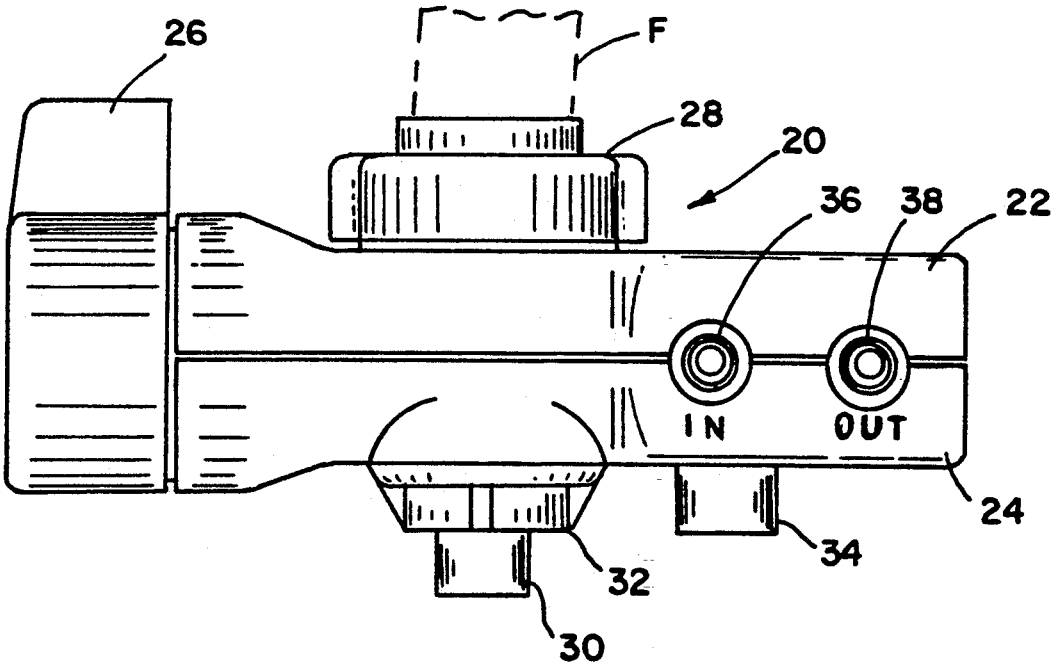
FIG. 2 is a rear elevational view of the faucet diverter valve.

By way of disclosing a preferred embodiment of the invention, and not by way of limitation, there is shown in FIGS. 1 and 2 a faucet diverter valve 20 which includes in its general organization an upper shroud 22, a lower shroud 24, a handle 26 rotatable about the longitudinal axis of the faucet diverter valve, a compression nut 28 encircling a fluid inlet by which the faucet diverter valve is attached to a faucet F, a straight stream outlet 30, a spray outlet 32, a treated stream outlet 34, an untreated water exit 36, and a treated water entrance 38. With the faucet diverter valve in its normal orientation, outlets 30, 32, and 34 are directed downwardly, while exit 36 and entrance 38 are directed toward the rear. Spray outlet 32 coaxially encircles straight stream outlet 30.

Figure 13:
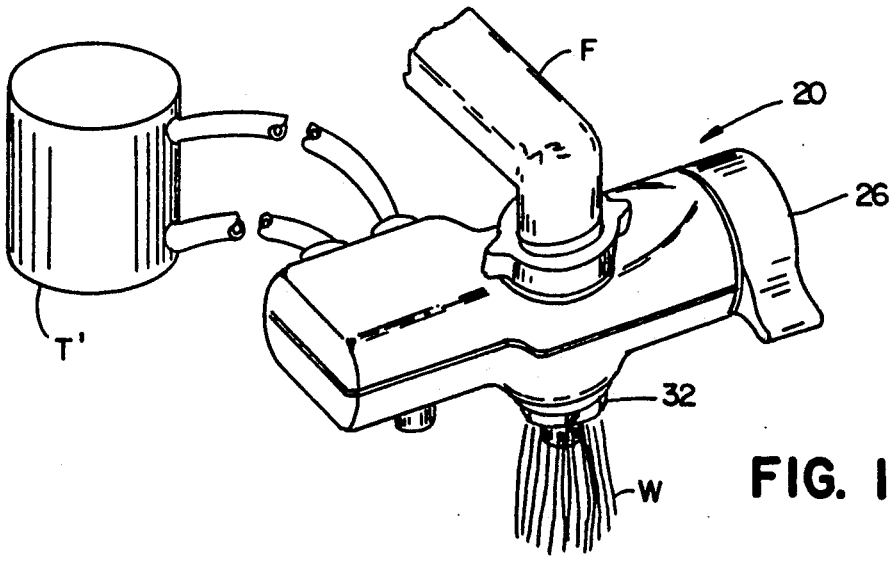
FIG. 13 is a front and top perspective view of the faucet diverter valve connected to a faucet and a water treatment device, with the handle in a first position for the delivery of a spray of untreated water.
Figure 14:
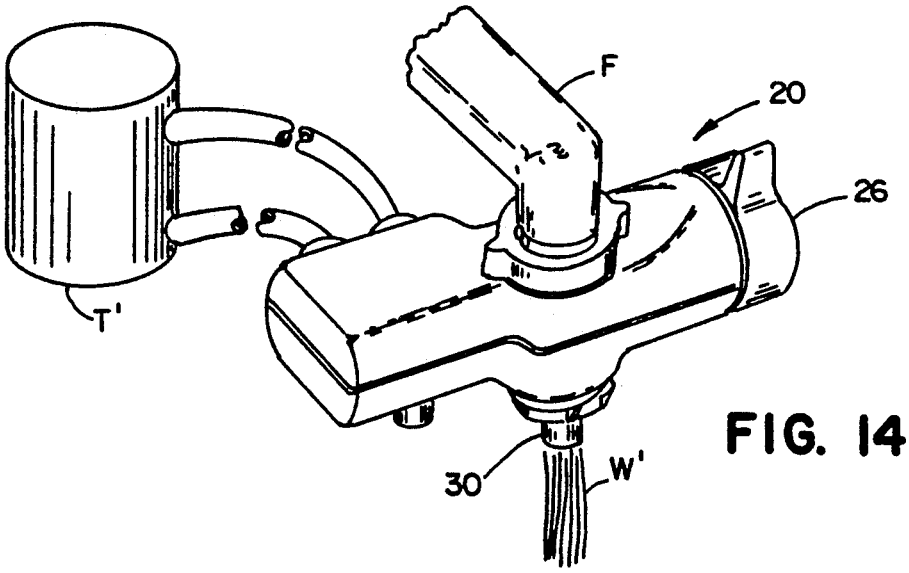
FIG. 14 is similar to FIG. 13, but with the handle in a second position for the delivery of a stream of untreated water.
Figure 15:
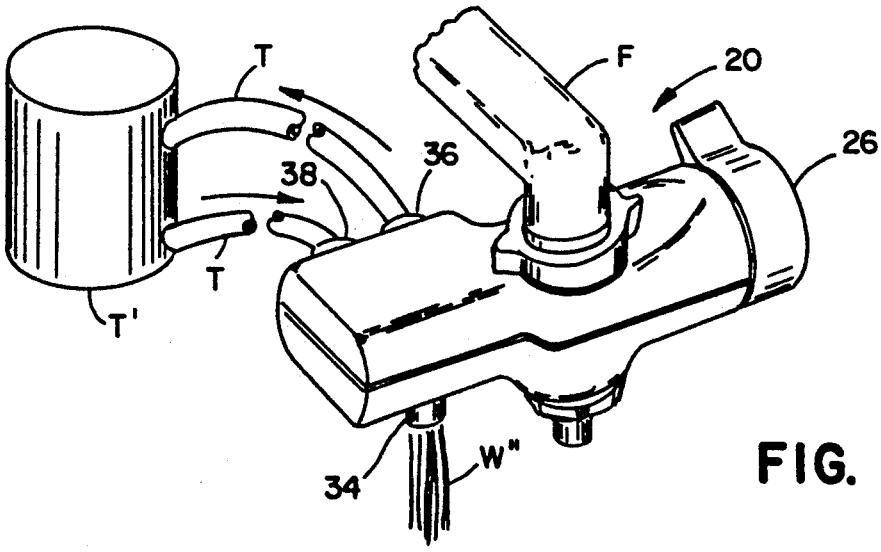
FIG. 15 is similar to FIG. 13, but with the handle in a third position for the delivery of a stream of treated water.

As shown in FIGS. 13–15, and as described more fully below, handle 26 may be selectably rotated to any of three positions separated by increments of ninety degrees of rotation. In each of the three positions, untreated water is directed from the faucet F out of either the spray outlet 32 (FIG. 13) or the straight stream outlet 30 (FIG. 14), or treated water is directed out of the treated stream outlet 34 (FIG. 15). Water exiting the treated stream outlet 34 first passes from the faucet out of untreated water exit 36, and through suitable tubing T to a treatment device T'. Treated water returns from the treatment device through suitable tubing into treated water entrance 38, and finally through treated stream outlet 34.

Figure 3:
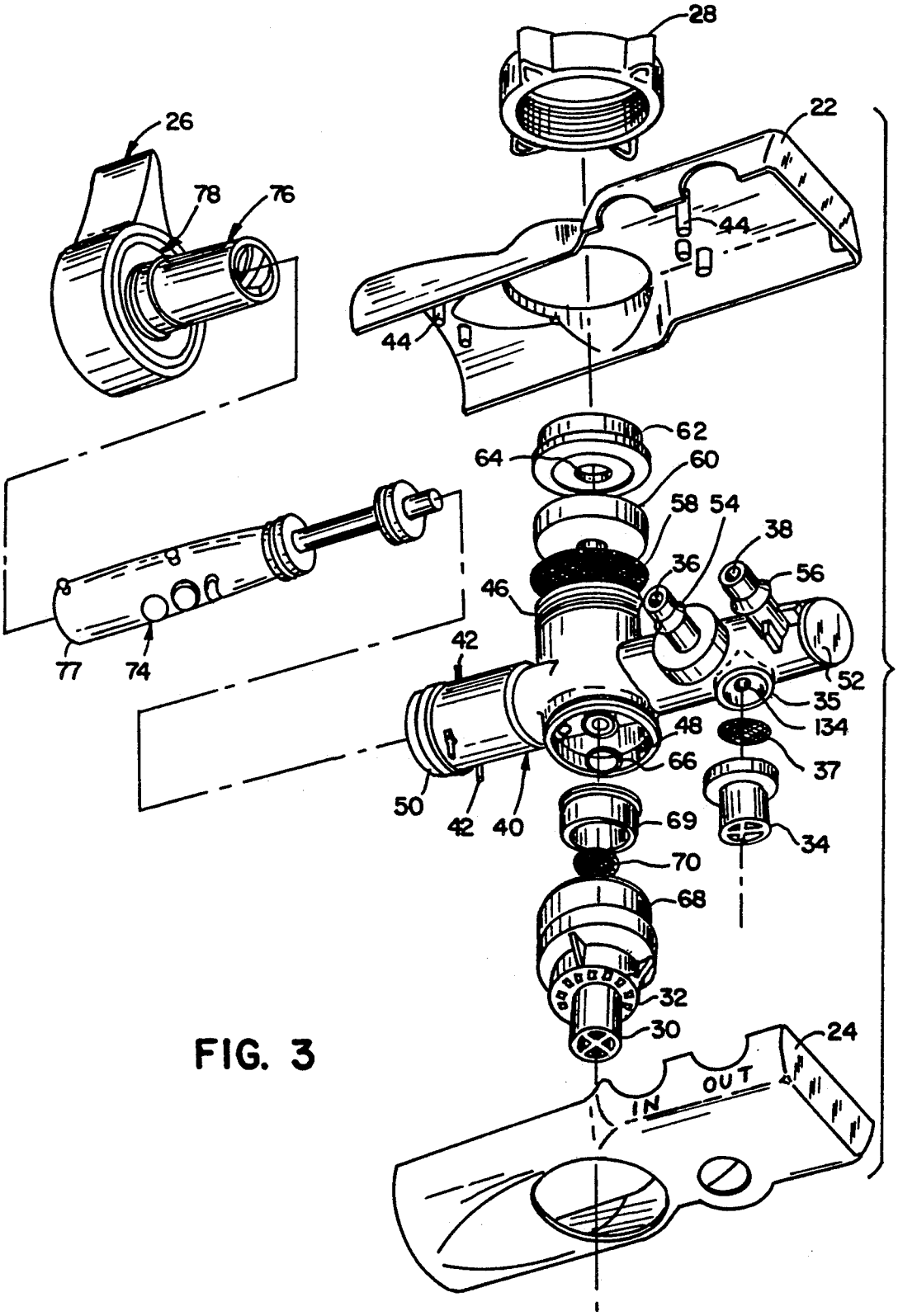
FIG. 3 is a rear and underside, exploded, perspective view of the faucet diverter valve.

Further assembly details of the faucet diverter valve are shown in FIG. 3. Manifold 40 is housed between the upper and lower shrouds 22, 24. Several pins 42 are formed on the exterior of the manifold and interior of the bottom shroud which snap fit with corresponding recesses 44 formed on the interior of both shrouds to hold the shrouds in assembled relationship with the manifold.

Manifold 40 is generally in the form of an elongated cylinder having its longitudinal axis disposed coaxially with the axis of rotation of handle 26. The interior surface of the manifold encloses an axially elongated interior space. The central upper extent of the manifold is formed with an externally threaded, cylindrical inlet collar 46. The lower central extent of the manifold is formed with an externally threaded, cylindrical outlet collar 48 directly below the inlet collar 46. The end 50 of the manifold nearest the handle 26 is open and externally threaded. The end 52 of the manifold opposite the handle is closed.

The extent of the manifold adjacent end 52 is formed with the untreated water exit 36 and the treated water entrance 38 extending horizontally and transversely with respect to the longitudinal axis of the manifold. Exit 36 and entrance 38 are formed with external barbs 54, 56 for engaging and retaining flexible tubing leading to and from a treatment device. Below and between the exit 36 and entrance 38, the manifold is formed with downwardly directed collar 35 encircling opening 134. Treated stream outlet 34 is affixed to the collar 35. Screen 37 is captured between the opening 134 and the treated stream outlet 34.

Particle screen 58 is disposed within the inlet collar 46. Resilient compression gasket 60 rests atop screen 58. Adapter ring 62 rests atop compression gasket 60. Advantageously, adapter ring 62 is interchangeable with other adapters designed to mate with a variety of faucets. Compression nut 28 is screwed onto the threads of inlet collar 46 to capture the screen 58, compression gasket 60, and adapter ring 62.

Resilient O-rings 66, 68 and baffle ring 69 are disposed within the spray outlet 32. Straight stream outlet 30, spray outlet 32, and outlet screen 70 are joined as an assembly which is screwed onto outlet collar 48, thus capturing the O-rings 66, 68 and baffle ring 69.

Valve spool 74, to be described more fully below, is inserted coaxially within the manifold 40. Handle 26 is attached to spool driver 76. The end 77 of the valve spool 74 nearest the handle fits coaxially within the spool driver 76. Valve spool 74 and spool driver 76 are inserted within the open end 50 of the manifold and secured in place by spool retainer nut 78.

Figure 4:
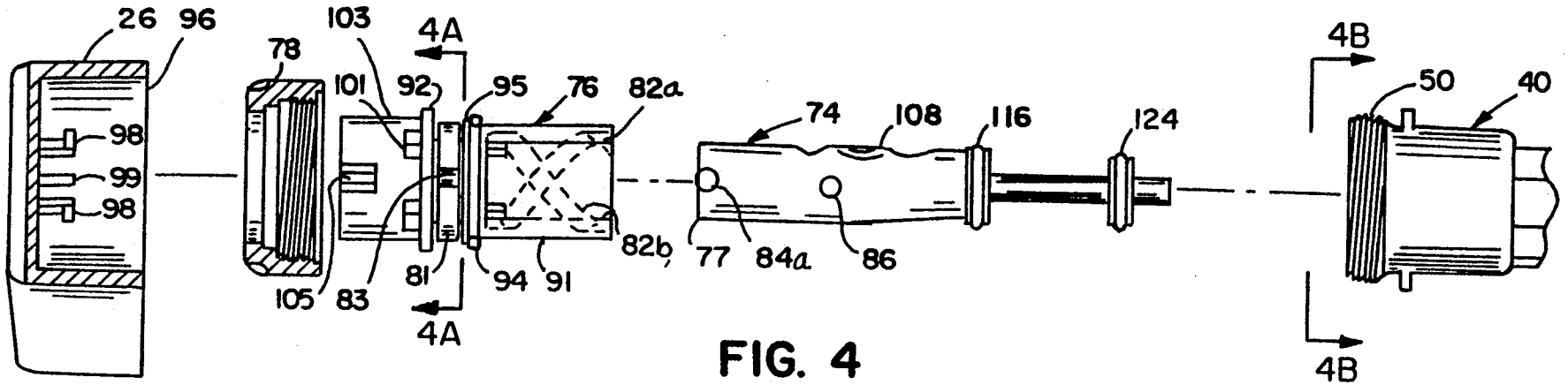
FIG. 4 is a rear, elevational, exploded view showing the assembly of the handle, spool driver, valve spool, and manifold.
Figure 4B:
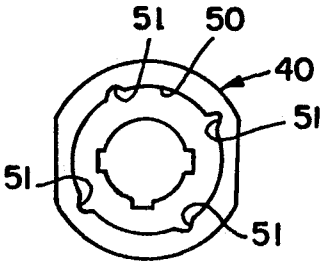
FIG. 4B is an axial, elevational view taken along the line B—B of FIG. 4.
Figure 4A:
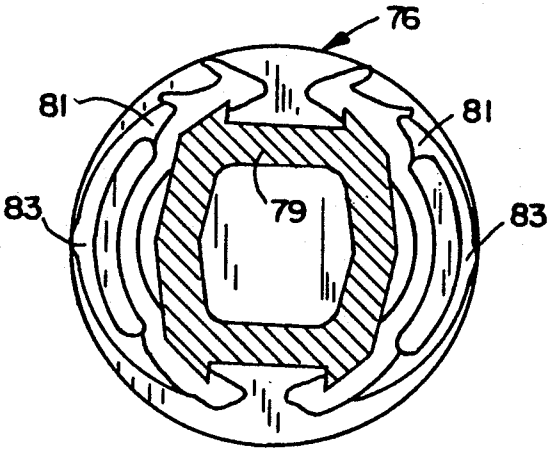
FIG. 4A is an enlarged sectional view taken along the line A—A of FIG. 4.
Figure 5:
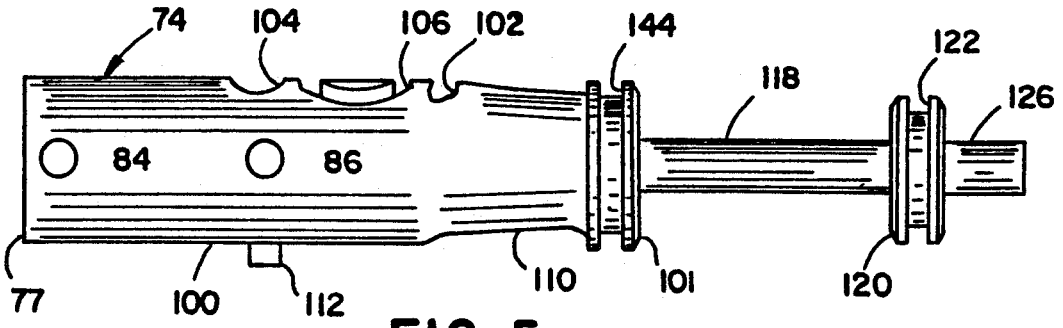
FIG. 5 is a rear elevational view of the valve spool.
Figure 6:
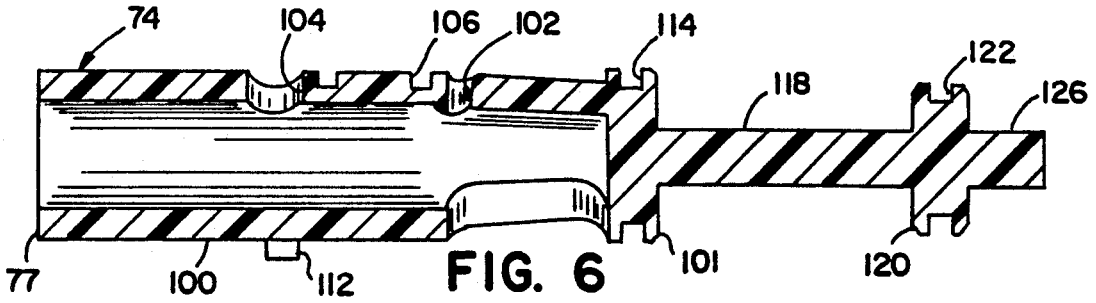
FIG. 6 is a rear, sectional, elevational view of the valve spool.
Figure 7:
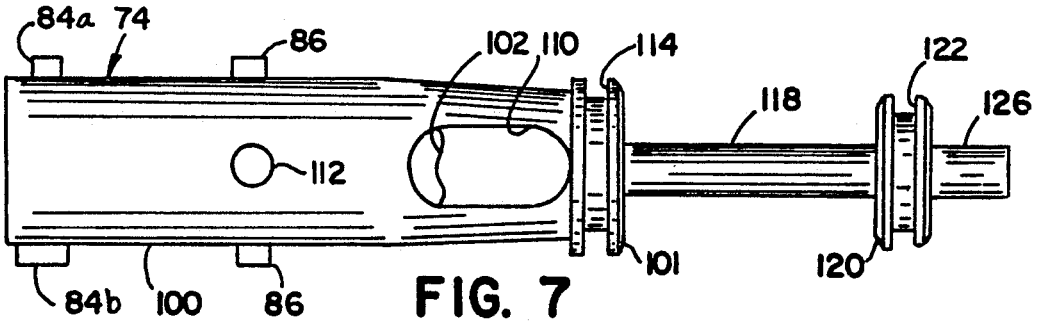
FIG. 7 is a top view of the valve spool.
Figure 8:
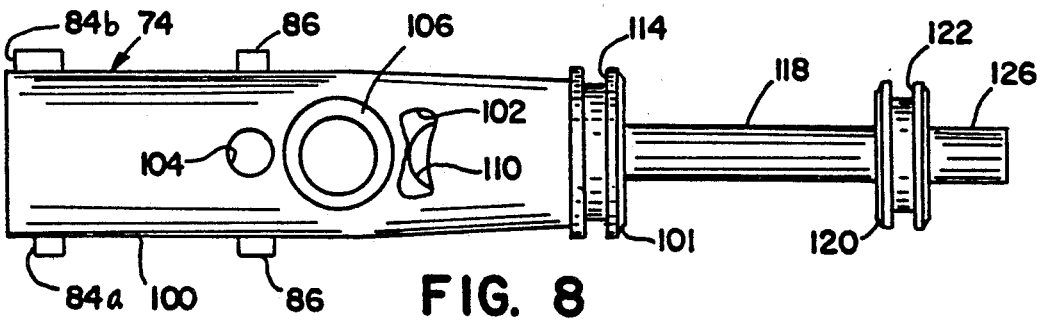
FIG. 8 is a bottom view of the valve spool.

Further details of the assembly of the handle, spool retainer nut, spool driver, valve spool and manifold are shown in FIGS. 4, 4A, and 4B.

Valve spool 74 is inserted into the open end 50 of the manifold 40. As shown in FIG. 4B, the inner circumference of the open end 50 of the manifold 40 is formed with four recesses 51 spaced apart by ninety degrees. As shown in FIG. 4B, spool driver 76 is formed with a narrowed central portion 79. A pair of diametrically opposed detent springs 81 are hooked on to the narrowed central portion 79. Each detent spring is formed with a protrusion 83. When the spool driver 76 is assembled within the manifold 40, the protrusions 83 of the detent springs engage diametrically opposed pairs of the recesses 51 of the manifold opening 50. Thus, the engagement of the protrusions 83 and recesses 51 cooperatively form detents which provide tactile feedback and facilitate positioning the handle 26 in one of its three operating positions.

Referring to FIG. 4, spool driver 76 is generally cylindrical having an end extent 91 with an inner diameter slightly larger than the outer diameter of the valve spool end 77. The inner surface of the spool driver is formed with a pair of diametrically opposed helical grooves 82*a*, 82*b* which receive bosses 84*a* and 84*b* (not shown) protruding from the valve spool. As described above, a central portion of the spool driver 76 is fitted with a pair of detent springs 81 which engage the inner circumference of the manifold opening 50.

Spool driver 76 further includes a flange 92 which abuts against the end 50 of the manifold 40. A resilient O-ring 94 is carried on the end extent 91 of the spool driver adjacent the detent springs 81 and positioned thereon by flange 95. O-ring 94 which seals against the inner surface of the manifold. Spool retainer nut 78 is threaded onto the end 50 of manifold 40, thus capturing the valve spool 74 and spool driver 76 in assembly with the manifold 40.

Details of the valve spool 74 are shown in FIGS. 5–8. Valve spool 74 comprises a hollow cylindrical body portion 100 having an open end 77 and an opposite closed end 101. The lower extent of the body portion is formed with two axially spaced apart openings 102, 104 communicating with the interior of the body portion. Between the openings 102, 104 is formed a circular recess 106 in which is received a resilient O-ring 108 (FIG. 4) which seals against the inner surface of the manifold 40. The upper extent of the body portion is formed with an axially elongated opening 110.

The opposed outer side extents of the valve spool body portion are formed with a first pair of bosses 84*a*, 84*b*, and a second pair of bosses 86. Boss 84*b* is larger than 84*a*. Helical groove 82*b* in the spool driver 76 (FIG. 4)is wider than helical groove 82*a* such that the spool driver and valve spool can be assembled only in the proper relationship.

The upper surface of the body portion of the valve spool is formed with a single boss 112. A groove 114 is formed around the body portion adjacent the closed end 101. Groove 114 receives a resilient O-ring 116 (FIG. 4) which seals against the inner surface of the manifold 40.

Valve spool 74 further includes a shaft 118 extending axially from the end 101 of the cylindrical body portion 100. O-ring 116 is disposed between the body portion 100 and the shaft 118. The end of the shaft 118 opposite end 101 is formed with a disk-like bulkhead 120. The circumference of bulkhead 120 is formed with a groove 122 in which is received a resilient O-ring 124 (FIG. 4) which seals against the inner surface of the manifold 40.

Valve spool 74 also includes spacer 126 extending axially beyond bulkhead 120. The free end of spacer 126 is adapted to contact the inner surface of the closed end 52 (FIG. 3) of manifold 40 to limit the travel of the valve spool within the manifold.

Referring again to FIG. 4, handle 26 is formed with a recess 96 directed toward the manifold. Within the recess 96, the handle is formed with hooked fingers 98 and pins 99. Fingers 98 extend within the interior of the spool driver 76 and engage recesses 101 formed in the inner wall of the outer extent 103 of the spool driver. The outer extent of the spool driver is also formed with recesses 105 which are keyed to the pins 99. Thus, the handle is held in assembly with the spool driver and manifold. Rotation of the handle causes the spool driver 74 to rotate within the manifold. Rotation of the spool driver 74 is converted into axial, linear movement of the valve spool 74 within the manifold by the cooperation of the bosses 84*a*, 84*b* of the valve spool with the helical internal grooves 82*a*, 82*b* of the spool driver.

Figure 9:
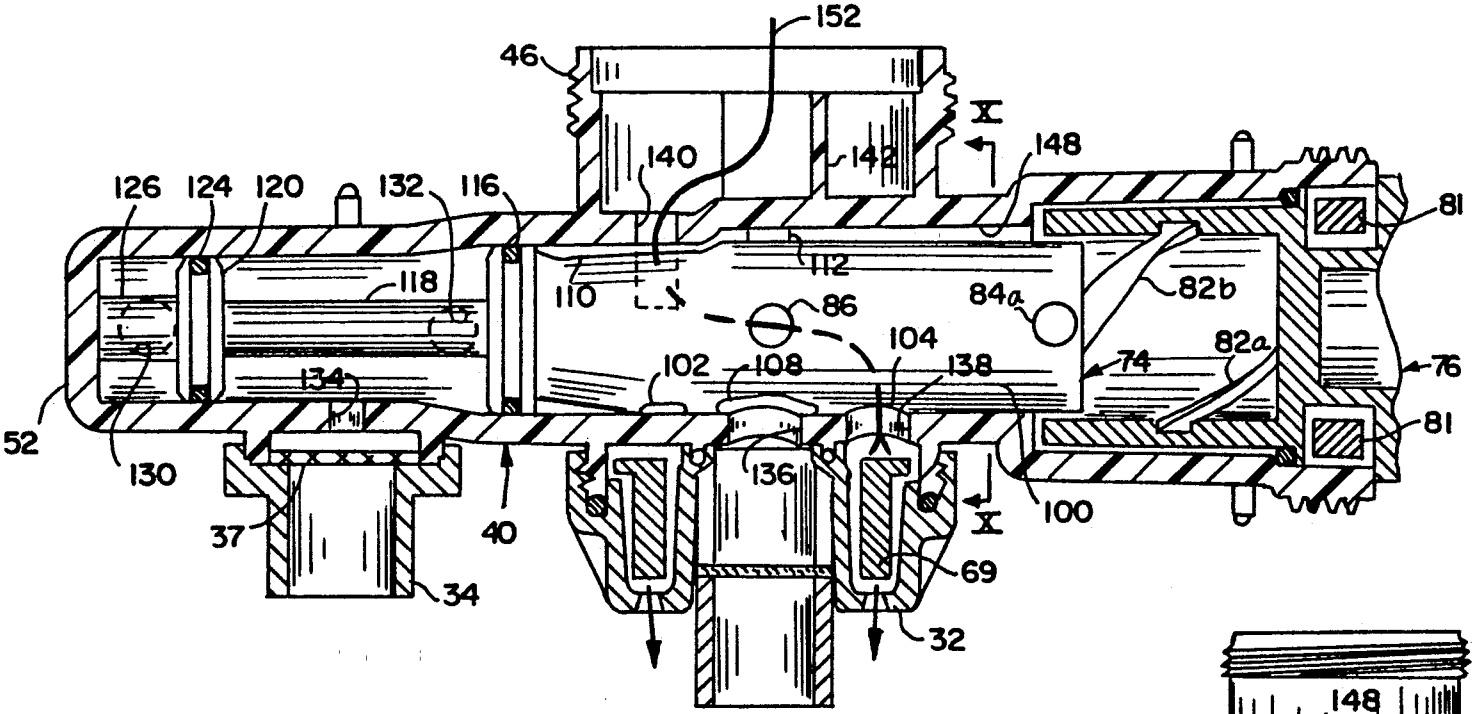
FIG. 9 is a front elevational view of the manifold and valve spool with the manifold in vertical section showing the spool in the untreated spray position.

FIG. 9 shows further details of the manifold 40. In the portion of the manifold near the closed end 52 there is formed through the wall of the manifold an opening 130 which communicates with the treated water entrance 38 (FIG. 3). Axially spaced apart from opening 130 and disposed between opening 130 and the central portion of the manifold there is formed opening 132 which communicates with untreated water exit 36. Below and between openings 130 and 132 the manifold is formed with opening 134 which communicates with treated stream outlet 34. At the bottom central portion of the manifold there is formed opening 136 which communicates with straight stream outlet 30. Adjacent to opening 136 and disposed between opening 136 and the open end of the manifold there is formed opening 138 in communication with spray outlet 32. The upper central portion of the manifold is formed with opening 140 in communication with the interior of inlet collar 46.

A support wall 142 extends across the interior of inlet collar 46. The upper edge of support wall 142 provides support for particle screen 58 and compression gasket 60 (FIG. 3).

Figure 10:
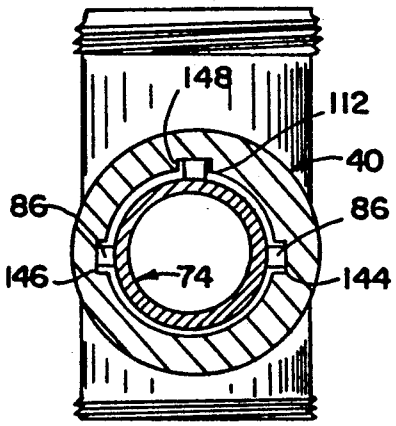
FIG. 10 is a sectional view taken substantially along the line X—X of FIG. 9.

As shown in FIG. 10, the internal surface of the central portion of the manifold 40 is formed with an opposed pair of side grooves 144, 146 and an upper groove 148. Side bosses 86 slide within grooves 144 and 146. Upper boss 112 slides within groove 148. The cooperation of the bosses 86, 112 with the grooves 144, 146 and 148 prevents valve spool 7 from rotating within the manifold.

Figure 11:
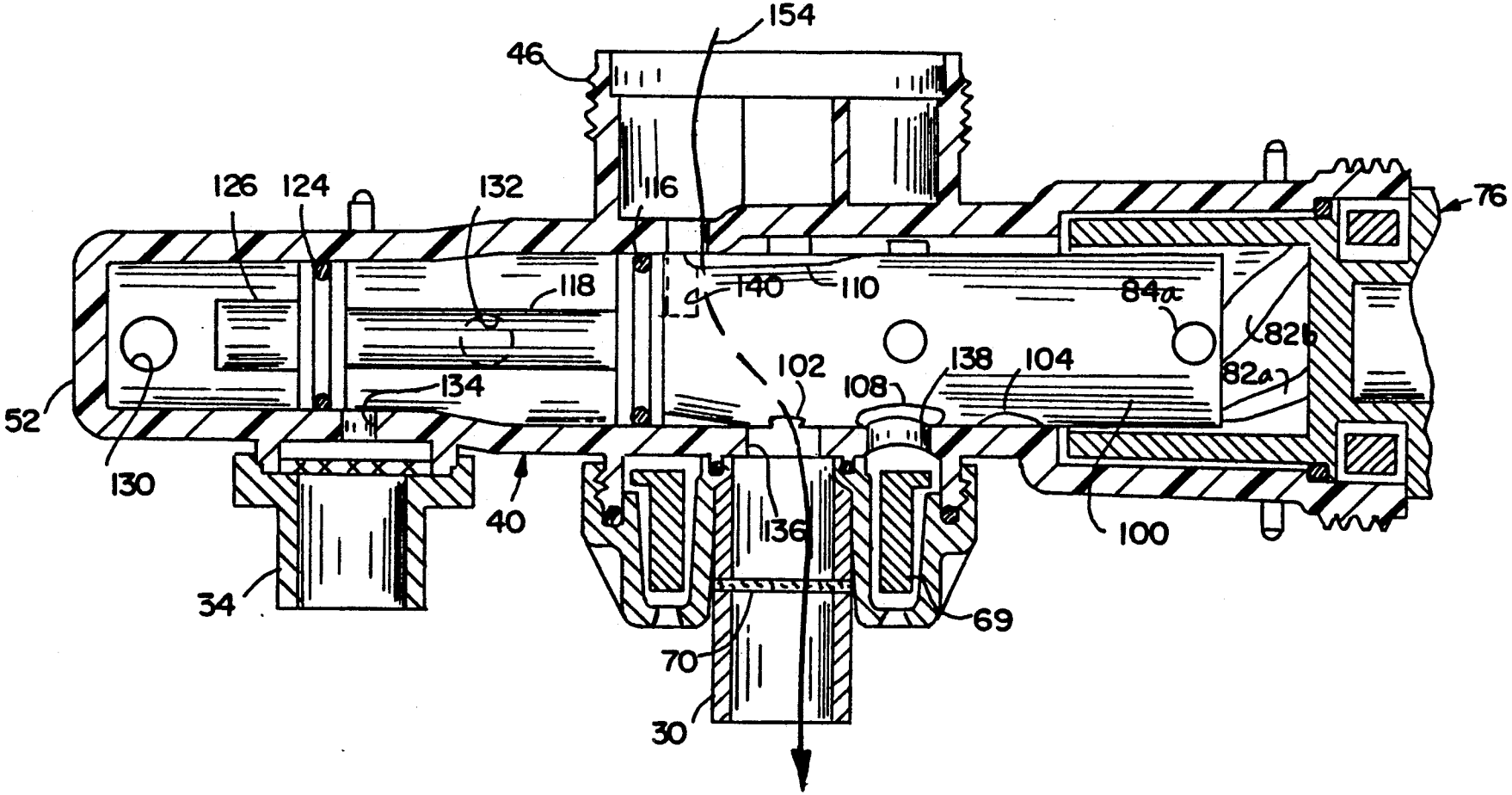
FIG. 11 is similar to FIG. 9, but showing the valve spool in the untreated stream position.
Figure 12:
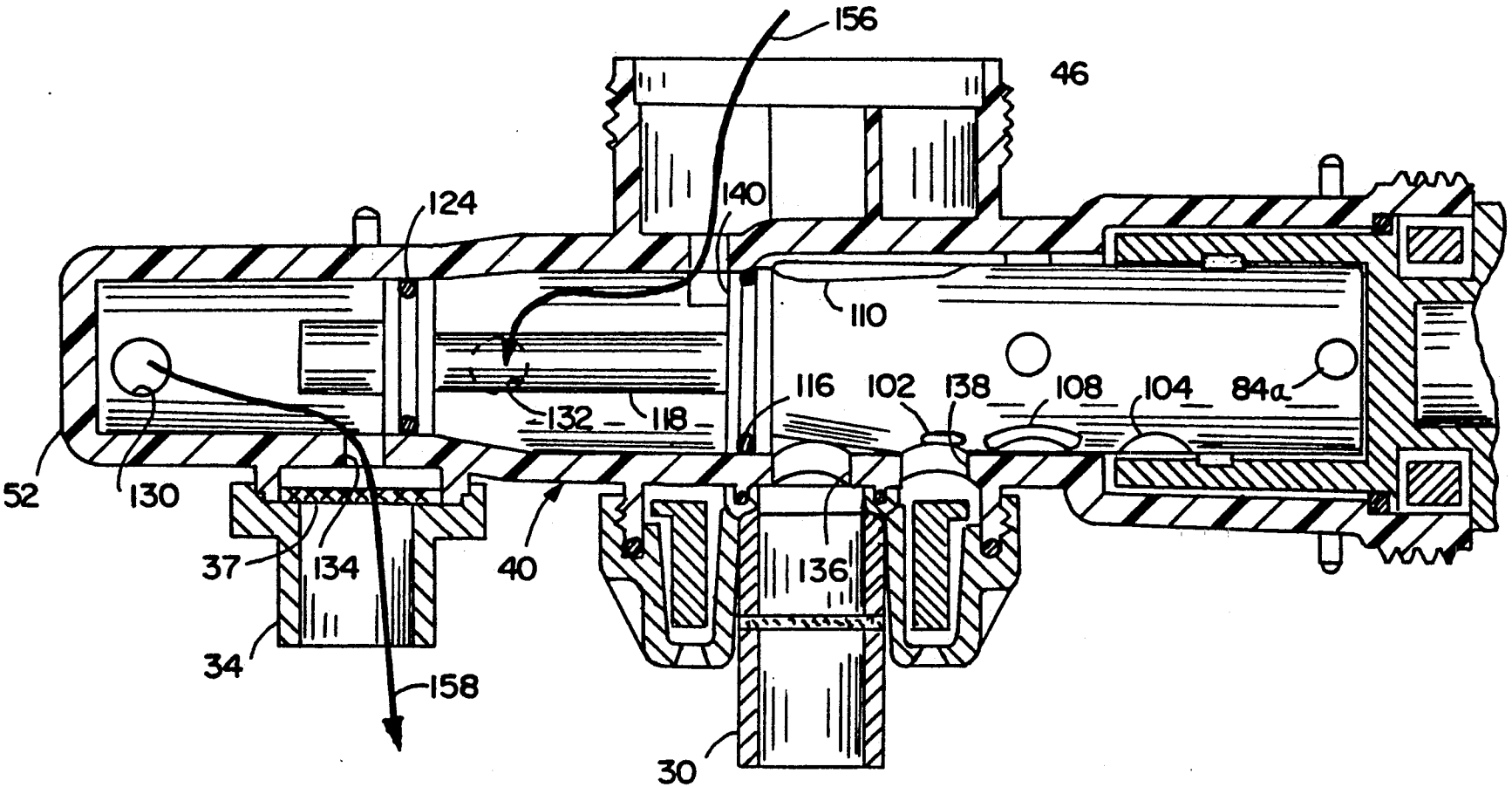
FIG. 12 is similar to FIG. 9, but showing the valve spool in the treated stream position.

The cooperation of the valve spool 74 with the manifold 40 to define the three operating positions of the faucet diverter valve is shown in FIGS. 9, 11, and 12, and in corresponding FIGS. 13, 14, and 15.

FIGS. 9 and 13 show the operation of the faucet diverter valve 20 in which handle 26 is in a first position and in which untreated water W from the faucet F flows through the spray outlet 32. The path of the water is indicated in FIG. 9 by flow arrow 152. In this position, the handle is rotated such that valve spool is moved axially toward manifold end 5 with spacer 126 in contact with end 52. Valve spool opening 110 is aligned with manifold opening 140 such that water flows from the faucet through inlet collar 46 into the interior of the valve spool body portion 100. Water continues to flow through valve spool opening 104, through manifold opening 138, around baffle ring 69, and out spray outlet 32. Manifold opening 136 is encircled and sealed off by O-ring 108. Water is prevented from flowing to openings 132 and 134 by O-ring 116. Water is prevented from flowing through openings 130 and 134 by O-ring 124.

FIGS. 11 and 14 show the operation of the faucet diverter valve 20 in which handle 26 is in a second position and in which untreated water W' from the faucet F flows through the straight stream outlet 30. The path of the water is indicated in FIG. 11 by flow arrow 154. In this position, the handle and spool driver 76 have been rotated ninety degrees with respect to the position shown in FIGS. 9 and 13. Thus, the spacer 126 of the valve spool has withdrawn from the manifold end 52 by a distance equal to the spacing between the manifold openings 136 and 138. Due to the elongation of valve spool opening 110, opening 110 remains aligned with manifold opening 140 such that water flows from the faucet through inlet collar 46, opening 140, and opening 110 into the interior of the valve spool body portion 100. Water continues to flow through valve spool opening 102, through manifold opening 136, screen 70, and straight stream outlet 30. Manifold opening 138 is now encircled and sealed off by O-ring 108. Manifold openings 130, 132 and 134 continue to be sealed off from the flow of water by O-rings 124 and 116.

FIGS. 12 and 15 show the operation of the faucet diverter valve 20 in which handle 26 is in a third position in which water is diverted through a treatment loop. Water from the faucet F flows out of exit 36 through tubing T to the treatment device T'. Water returns through the tubing into entrance 38 and is delivered as a stream of treated water W" through outlet 34. The path of the water is indicated in FIG. 12 by flow arrows 156 and 158. In this position, the handle and spool driver 76 have rotated an additional ninety degrees with respect to the position shown in FIGS. 11 and 14. Thus, the valve spool 74 is withdrawn from the manifold end 52 a additional distance sufficient to place O-ring 124 and 116 on the opposite side of manifold openings 134 and 140 respectively. Water flows from the faucet through inlet collar 46 and manifold opening 140 into the interior portion of the manifold partially occupied by shaft 118. Water continues to flow through manifold opening 132 to the untreated water exit 36 (FIG. 3) and through the tubing to the treatment device. Treated water returns through the tubing to treated water entrance 38 (FIG. 3) and reenters the manifold through opening 130. The water exits the manifold through opening 134, screen 37, and treated stream outlet 34. O-ring 116 prevents untreated water from passing through openings 136 and 138. O-ring 124 at all times prevents untreated water from intermingling with treated water.

The major components of the faucet diverter valve, such as the manifold, spool, spool driver, handle, and shrouds, are preferably made of molded plastic material.

Thus, the invention provides an effective and easily operated device for delivering a stream or spray of untreated water from a faucet, and for diverting water from a faucet to a treatment device and returning the water to the faucet.

The above description is that of a preferred embodiment of the invention. Various alterations and changes can be made without departing from the spirit and broader aspects of the invention as set forth in the appended claims, which are to be interpreted in accordance with the principles of patent law, including the Doctrine of Equivalents.

The embodiments of the invention in which an exclusive property or privilege is claimed are defined as follows:

1. A faucet diverter valve comprising:

a three-position valve having first, second and third outlets;

means for connecting said valve in fluid communication with a water faucet;

means for diverting water from said valve to a treatment device and for returning treated water from said treatment device to said valve;

a three-position handle operatively associated with said valve and having a first position wherein water flows from the faucet through said valve and out said first outlet, a second position wherein water flows from the faucet through said valve and out said second outlet, and a third position wherein water flows from the faucet through said valve, and out of said valve means through the treatment device, from the treatment device back to said valve means and out said third outlet; and seal means operatively associated with said valve for preventing water from flowing out of said third outlet when said handle is in said first and second positions.

2. The faucet diverter valve of claim 1 wherein the position of said handle is selected by rotating said handle into one of its three positions.

3. The faucet diverter valve of claim 2 wherein one of said first or second outlets is a spray outlet and the other of said first or second outlets is a straight stream outlet.

4. The faucet diverter valve of claim 1 wherein said seal means includes means for preventing water from flowing to the treatment device when said handle is in said first and second positions.

5. A faucet diverter assembly comprising:

a valve manifold;

faucet connector means for connecting said valve manifold to a water faucet;

treatment device connector means for connecting said valve housing to a water treatment device;

spray stream outlet means on said valve manifold for discharging water as a spray stream;

straight stream outlet means on said valve manifold for discharging water as a straight stream;

a valve actuator movable within said valve manifold among a first position wherein said actuator permits water to flow from said faucet connector means to said spray stream outlet means bypassing said treatment device connector means, a second position wherein said actuator permits water to flow from said faucet connector means to said straight stream outlet means bypassing said treatment device connector means, and a third position wherein said actuator permits water to flow from said faucet connector means to said treatment device connector means and from said treatment device connector means to said straight stream outlet means, whereby water may be discharged selectively as an untreated spray stream, an untreated straight stream, or a treated straight stream; and seal means for preventing water flow from said treatment device connector means to said straight stream outlet means when said valve actuator is in said first and second positions.

6. The faucet diverter assembly of claim 5 further comprising a handle means operatively associated with said valve actuator means for selectively moving said valve actuator among said first position, said second position, and said third position.

7. The faucet diverter assembly of claim 5 wherein said seal means includes means for preventing water flow from said water connector means to said treatment device connector means when said valve actuator is in said first and second positions.

8. The faucet diverter assembly of claim 6 wherein said handle means comprises a rotatable handle.

9. A faucet diverter assembly comprising:

a valve manifold;

faucet connector means for connecting said valve manifold to a water faucet;

treatment device connector means for connecting said valve housing to a water treatment device;

spray stream outlet means on said valve manifold for discharging water as a spray stream;

straight stream outlet means on said valve manifold for discharging water as a straight stream;

a valve actuator movable within said valve manifold among a first position wherein said actuator permits water to flow from said faucet connector means to said spray stream outlet means bypassing said treatment device connector means, a second position wherein said actuator permits water to flow from said faucet connector means to said straight stream outlet means bypassing said treatment device connector means, and a third position wherein said actuator permits water to flow from said faucet connector means to said treatment device connector means and from said treatment device connector means to said straight stream outlet means, said valve actuator being axially, reciprocably movable within said valve manifold;

a rotatable handle operatively associated with said valve actuator means for selectively moving said valve actuator among said first position, and said second position, said third position; and means operatively interconnecting said rotatable handle and said valve actuator for converting rotational movement of said handle to axial movement of said valve actuator, whereby water may be discharged selectively as an untreated spray stream, an untreated straight stream, or a treated straight stream.

10. A faucet diverter valve comprising:

a manifold having an interior surface enclosing an axially elongated interior space, said manifold having a fluid inlet, a fluid entrance, a first untreated fluid outlet, a treated fluid outlet, and a fluid exit;

means for attaching said manifold to a faucet and defining a flow path from the faucet through said fluid inlet into said interior space of said manifold;

means defining a flow path from said fluid exit to a fluid treatment device;

means defining a flow path from the fluid treatment device to said fluid entrance;

a valve means axially movable within said manifold between a first position and a second position;

seal means carried by said valve means in sliding, sealing contact with said interior surface of said manifold;

wherein when said valve means is in said first position said fluid inlet is in fluid communication with said first untreated fluid outlet and said seal means prevents fluid flow both from said fluid inlet to said fluid exit and from said fluid entrance to said treated outlet; and wherein when said valve means is in said second position said fluid inlet is in fluid communication with said fluid exit, said fluid entrance is in fluid communication with said treated fluid outlet, and said seal means prevents fluid flow from said fluid inlet to said first untreated fluid outlet.

11. The faucet diverter valve of claim 10 wherein said seal means further prevents fluid flow from said fluid entrance to said treated fluid outlet when said valve means is in said first position.

12. The faucet diverter valve of claim 11 further comprising;

a handle means, said handle means rotatable about the axis of said manifold;

means of interengaging said handle means and said valve means whereby rotation of said handle causes said valve means to move between said first position and said second position.

13. A faucet diverter valve comprising:

a manifold having an interior surface enclosing an axially elongated interior space, said manifold having a fluid inlet, a fluid entrance, a first untreated fluid outlet, a treated fluid outlet, and a fluid exit;

means for attaching said manifold to a faucet and defining a flow path from the faucet through said fluid inlet into said interior space of said manifold;

means defining a flow path from said fluid exit to a fluid treatment device;

means defining a flow path from the fluid treatment device to said fluid entrance;

a valve means axially movable within said manifold between a first position and a second position;

seal means carried by said valve means in sliding, sealing contact with said interior surface of said manifold;

a handle means, said handle means rotatable about the axis of said manifold;

means for interengaging said handle means and said valve means whereby rotation of said handle causes said valve means to move between said first position and said second position, said means for interengaging comprising a cylindrical spool driver formed with at least one internal helical groove and further comprising means on said valve means extending within said spool driver and engaging said internal helical groove;

wherein when said valve means is in said first position said fluid inlet is in fluid communication with said first untreated fluid outlet, said seal means prevents fluid flow from said fluid inlet to said fluid exit, and said seal means further prevents fluid flow from said fluid entrance to said treated fluid outlet; and wherein when said valve means is in said second position said fluid inlet is in fluid communication with said fluid exit, said fluid entrance is in fluid communication with said treated fluid outlet, and said seal means prevents fluid flow from said fluid inlet to said first untreated fluid outlet.

14. A faucet diverter valve comprising:

a manifold having an interior surface enclosing an axially elongated interior space, said manifold having a fluid inlet, a fluid entrance, a first untreated fluid outlet, a second untreated fluid outlet, a treated fluid entrance, and a fluid exit;

means for attaching said manifold to a faucet and defining a flow path from the faucet through said fluid inlet into said interior space of said manifold;

means defining a flow path from said fluid exit to a fluid treatment device;

means defining a flow path from the fluid treatment device to said fluid entrance;

valve means axially movable within said manifold among a first position, a second position, and a third position;

seal means carried by said valve means in sliding, sealing contact with said interior surface of said manifold;

wherein when said valve means is in said first position said fluid inlet is in fluid communication with said first untreated fluid outlet and said seal means prevents fluid flow from said fluid inlet to said fluid exit;

wherein when said valve means is in said second position said fluid inlet is in fluid communication with said fluid exit, said fluid entrance is in fluid communication with said treated fluid outlet, and said seal means prevents fluid flow from said fluid inlet to said first untreated fluid outlet; and wherein when said valve means is in said third position said fluid inlet is in fluid communication with said second untreated fluid outlet and said seal means prevents fluid flow from said fluid inlet to said fluid exit.

15. The faucet diverter valve of claim 14 wherein one of said first untreated fluid outlet or said second untreated fluid outlet comprises a straight stream outlet and the other of said first untreated fluid outlet o said second untreated fluid outlet comprises a spray outlet.

16. A faucet diverter valve comprising:

a manifold having an interior surface enclosing an axially elongated space with a closed end and an axially opposite open end, said manifold having a central portion formed with a fluid inlet, a first untreated fluid outlet, and a second untreated fluid outlet disposed between said first untreated fluid outlet and said open end, a closed end portion disposed between said central portion and said closed end, said closed end portion formed with a fluid entrance disposed adjacent said closed end, a fluid exit disposed between said fluid entrance and said central portion, and a treated fluid outlet disposed between said fluid entrance and said fluid exit;

means for attaching said manifold to a faucet and defining a fluid flow path from the faucet through said fluid inlet;

means for attaching said fluid exit to a fluid treatment device and defining a fluid flow path from said fluid exit to said treatment device;

means for attaching said fluid entrance to the treatment device and defining a fluid flow path from the treatment device to said fluid entrance;

valve means disposed within said elongated space of said manifold and axially, selectably movable therein among a first position, a second position, and a third position, said valve means having a body portion disposed in said central portion of said manifold and a shaft extending from said body portion into said closed end portion of said manifold;

first seal means carried on said body portion of said valve means in sliding, sealing engagement with said interior surface of said manifold;

a second seal means carried on said valve means disposed between said body portion and said shaft and in sliding, sealing engagement with said interior surface of said manifold;

a third seal means carried on said shaft in sliding sealing engagement with said interior surface of said manifold;

wherein when said valve means is in said first position said first seal means seals off said second untreated fluid outlet, said second seal means seals off said fluid inlet from said fluid exit, and said third seal means seals off said fluid entrance from said fluid exit and said treated fluid outlet, thereby forming a fluid flow path from said faucet through said fluid inlet and said first untreated fluid outlet;

wherein when said valve means is in said second position said first seal means seals off said first untreated fluid outlet, said second seal means seals off said fluid inlet from said fluid exit, and said third seal means seals off said fluid entrance from said fluid exit and said treated fluid outlet, thereby forming a fluid flow path from said faucet through said fluid inlet and said second untreated fluid outlet; and wherein when said valve means is in said third position said second seal means seals off said fluid inlet from first untreated fluid outlet and said second untreated fluid outlet, and said third seal means seals off said fluid exit from said fluid entrance and said treated fluid outlet, thereby forming a fluid flow path from said faucet through said fluid inlet, from said fluid inlet through said fluid exit to the treatment device, from the treatment device to said fluid entrance, and from said fluid entrance through said treated fluid outlet.

17. The faucet diverter valve of claim 16 further comprising;

a handle means disposed at said open end of said manifold, said handle means rotatable about the axis of said manifold;

means for drivingly interengaging said handle means and said valve means whereby rotation of said handle selectably causes said valve means to move among said first position, said second position, and said third position.

18. The faucet diverter valve of claim 17 wherein said means for interengaging comprises a cylindrical spool driver formed with at least one internal helical groove and extending within said manifold, said body portion of said valve means extending within said spool driver and having means engaging said helical groove.

19. The faucet diverter valve of claim 17 wherein said valve means and said manifold are formed with cooperating means for constraining said valve means to linear, axial movement within said manifold.

20. The faucet diverter valve of claim 16 wherein said first untreated fluid outlet comprises a spray outlet.

21. The faucet diverter valve of claim 20 wherein said second untreated fluid outlet comprises a straight stream outlet.

22. The faucet diverter valve of claim 21 wherein said straight stream outlet is concentric with said spray outlet and encircled by said spray outlet.

23. A faucet diverter valve comprising:

an axially elongated, generally cylindrical manifold having a closed end, an open end opposite said closed end, a closed end portion adjacent said closed end, and a central portion disposed between said closed end portion and said open end;

a collar means extending upwardly from said central portion;

a fluid inlet forming a fluid flow path between said collar means and the interior of said manifold;

a first untreated fluid outlet disposed below said collar means;

a second untreated fluid outlet disposed below said collar means and between said first untreated fluid outlet and said closed end;

a fluid exit disposed in said closed end portion;

a fluid entrance disposed in said closed end portion between said fluid exit and said closed end;

a treated fluid outlet disposed in said closed end portion between said fluid exit and said fluid entrance;

means for interconnecting said fluid exit to the inlet of a treatment device;

means for interconnecting said fluid entrance to the outlet of the treatment device;

an axially elongated valve spool disposed within said manifold and axially movable therein among a first position, a second position, and a third position; said valve spool having a generally cylindrical body portion disposed in said central portion of said manifold;

an axial shaft extending from said body portion into said closed end portion of said manifold;

a bulkhead carried on said shaft disposed between said fluid entrance and said fluid exit;

a first seal carried on said cylindrical body portion disposed in sealing, sliding contact with the inner surface of said central portion of said manifold;

a second seal carried on and encircling said cylindrical body disposed in sealing, sliding contact with the inner surface of said central portion of said manifold adjacent said closed end portion of said manifold;

a third seal carried on and encircling said bulkhead in sealing, sliding contact with the inner surface of said closed end portion of said manifold between said fluid entrance and said fluid exit;

a cylindrical spool driver extending axially into said open end of said manifold and formed with at least one internal helical groove, said body portion of said valve spool extending into said spool driver and having means for engaging said helical groove, whereby rotation of said spool driver causes said valve spool to move axially within said manifold;

a rotatable handle means in driving engagement with said spool driver, whereby rotation of said handle means causes said valve spool to be selectably moved among said first position, said second position, or said third position;

means for attaching said collar to a faucet in fluid communication therewith;

wherein when said valve spool is in said first position said first seal seals off said second untreated fluid outlet, said second seal means seals off said fluid inlet from said fluid exit, and said third seal means seals off said fluid entrance from said fluid exit and said treated fluid outlet, thereby forming a fluid flow path from said faucet through said fluid inlet, said body portion, and said first untreated fluid outlet;

wherein when said valve spool is in said second position said first seal seals off said first untreated fluid outlet, said second seal means seals off said fluid inlet from said fluid exit, and said third seal means seals off said fluid entrance from said fluid exit and said treated fluid outlet, thereby forming a fluid flow path from said faucet through said fluid inlet, said body portion, and said second untreated fluid outlet; and wherein when said valve spool is in said third position said second seal seals off said fluid inlet from said first untreated fluid outlet and said second untreated fluid outlet, and said third seal seals off said fluid exit from said fluid entrance and said treated fluid outlet, thereby forming a fluid flow path from said faucet through said fluid inlet, from said fluid inlet through said fluid exit to the treatment device, from the treatment device to said fluid entrance, and from said fluid entrance through said treated fluid exit.

24. The faucet diverter valve of claim 23 further comprising a spray outlet in fluid communication with said first untreated fluid outlet.

25. The faucet diverter valve of claim 23 further comprising a straight stream outlet in fluid communication with said second untreated fluid outlet.

26. The faucet diverter valve of claim 25 wherein said straight stream outlet is encircled by said spray outlet.

27. The faucet diverter valve of claim 23 wherein said means for attaching said collar to a faucet comprises a one of a plurality of selectable, interchangeable adapters for mating with various faucets.

* * * * *

UNITED STATES PATENT AND TRADEMARK OFFICE

CERTIFICATE OF CORRECTION

PATENT NO. : 5,279,329
DATED : January 18, 1994
INVENTOR(S) : Bradley J. Pippel

It is certified that error appears in the above-indentified patent and that said Letters Patent is hereby corrected as shown below:

Column 10, claim 14, line 38:
after "said" insert --first--.

Column 10, claim 15, line 48:
"o" should be --or--.

Signed and Sealed this

Fourteenth Day of June, 1994

Bruce Lehman

*Attest:*

BRUCE LEHMAN

*Attesting Officer*

*Commissioner of Patents and Trademarks*